US007802970B2

(12) United States Patent
Singhal et al.

(10) Patent No.: US 7,802,970 B2
(45) Date of Patent: Sep. 28, 2010

(54) MICROPUMP FOR ELECTRONICS COOLING

(75) Inventors: Vishal Singhal, West Lafayette, IN (US); Suresh V. Garimella, West Lafayette, IN (US)

(73) Assignee: Purdue Research Foundation, West Lafayette, IN (US)

( * ) Notice: Subject to any disclaimer, the term of this patent is extended or adjusted under 35 U.S.C. 154(b) by 1156 days.

(21) Appl. No.: 11/442,834

(22) Filed: May 30, 2006

(65) Prior Publication Data

US 2007/0020124 A1 Jan. 25, 2007

Related U.S. Application Data

(63) Continuation of application No. PCT/US2004/040916, filed on Dec. 8, 2004.

(60) Provisional application No. 60/528,347, filed on Dec. 10, 2003.

(51) Int. Cl.
*F04B 37/02* (2006.01)
*F04B 17/00* (2006.01)

(52) U.S. Cl. ..... 417/48; 417/53; 417/410.2; 417/410.3

(58) Field of Classification Search ..... 417/48, 417/413.2, 413.3, 53, 199.1
See application file for complete search history.

(56) References Cited

U.S. PATENT DOCUMENTS

| | | | | |
|---|---|---|---|---|
| 6,126,140 | A * | 10/2000 | Johnson et al. | 251/129.01 |
| 6,179,584 | B1 | 1/2001 | Howitz et al. | 417/413 |
| 2002/0045287 | A1 | 4/2002 | Gamble et al. | 438/48 |
| 2002/0146330 | A1 | 10/2002 | Takeuchi et al. | 417/322 |
| 2003/0062149 | A1 | 4/2003 | Goodson et al. | 165/104.11 |
| 2003/0173873 | A1 | 9/2003 | Bryant et al. | 310/365 |
| 2003/0215342 | A1 | 11/2003 | Higashino et al. | 417/322 |
| 2003/0222942 | A1 | 12/2003 | Kitagawa et al. | 347/68 |

FOREIGN PATENT DOCUMENTS

| | | |
|---|---|---|
| DE | 0004422743 A1 | 1/1996 |
| SE | 9 300 604-7 | 8/1994 |
| WO | WO 94/19609 | 9/1994 |
| WO | WO 2005/060593 A2 | 7/2005 |

OTHER PUBLICATIONS

Tuckerman and Pease, "High Performance Heat Sinking for VLSI", IEEE Electron Device Letters, vol. EDL-2, pp. 126-129, 1981.

Garimella and Sobhan, "Transport in Microchannels- A Critical Review", Annual Review of Heat Transfer, vol. 14, 2003.

Stemme, et al., "A Valveless Diffuser/Nozzle-Based Fluid Pump", Sensors and Actuators A:Physical, vol. 39, pp. 159-167, 1993.

(Continued)

*Primary Examiner*—Charles G Freay

(57) ABSTRACT

A micropump including one or more microchannels for receiving a fluid and a plurality of electrodes arranged on a diaphragm and energized in a manner to provide an enhanced electrohydrodynamic flow of fluid through the one or more microchannels. The micropump may be used for pumping a working fluid for removing heat from a heat-generating electronic component or for delivery of a drug, medicine, or other treatment agent as or in a fluid to a patient.

14 Claims, 10 Drawing Sheets

OTHER PUBLICATIONS

Bart, S.F., et al., "Microfabricated Electrohydrodynamic Pumps", Sensors and Actuators A:Physical, 21-23, pp. 193-197, 1990.
Fuhr, G., et al., "Traveling Wave-Driven Microfabricated Electrohydrodynamic Pumps for Liquids", Journal of Micromechanics and Microengineering, 4, pp. 217-226, 1994.
U.S. Appl. No. 60/528,347, Dec. 2003, Singhal et al.
Gerlach, T., et al., "A New Micropump Principle of the Reciprocating Type Using Pyramidic Micro Flowchannels as Passive Valves", Journal of Micromechanics and Microengineering, 5, pp. 199-201, 1995.
Singhal, V., et al., "Numerical Characterization of Low Reynolds Number Flow Through the Nozzle-Diffuser Element in a Valveless Micropump", ASME/JSME Thermal Engineering Joint Conference, Hawaii, Mar. 2002 (in review).
Singhal, V., et al., "Microscale Pumping Technologies for Microchannel Cooling Systems", Appl. Mech. Rev., vol. 57, No. 3, May 2004.

* cited by examiner

MICROPUMP FOR ELECTRONICS COOLING

This application is a continuation of international PCT application PCT/US2004/040916 having international filing date of Dec. 8, 2004, which designates the United States, published in English under Article 21(2), which claims benefits and priority of U.S. provisional application Ser. No. 60/528,347 filed Dec. 10, 2003.

FIELD OF THE INVENTION

The invention relates to an electrohydrodynamic micropump with fluid flow rate enhancement.

BACKGROUND OF THE INVENTION

Rapidly decreasing features sizes and increasing power density in microelectronic devices has necessitated development of novel cooling strategies to achieve very high heat removal rates from these devices. For example, heat removal rates in excess of 200 W/cm$^2$ have been projected for the next generation of personal computing devices. Microchannel heat sinks have the potential to achieve these heat removal rates and therefore have been studied for over two decades as described, for example, by Tuckerman and Pease "High performance heat sinking for VLSI", IEEE Electron Device Letters, Vol. EDL-2, pp. 126-129, 1981, and by Garimella and Sobhan "Transport in microchannels-A critical review", Annual Review of Heat Transfer, Vol. 14, 2003. However, the high pressure drops encountered in microchannels have largely precluded their use in practical applications thus far. In particular, such microchannel heat sinks require an external pump to drive the fluid through the microchannels. The need for an external pump is quite disadvantageous in that relatively large amounts of electrical power and space would be needed for the pump.

Moreover, micropumps are being developed for delivering drugs, medicines or other treatment agents to patients. These micropumps require controllable rates of fluid flow to deliver exact amounts of a drug, medicine or other treatment agent to the patient.

SUMMARY OF THE INVENTION

The present invention provides in one embodiment a micropump that includes one or more microchannels for receiving a fluid and a plurality of electrodes arranged and energized in a manner to impart flow to fluid in the one or more microchannels.

An illustrative embodiment of the present invention provides a micropump that comprises a plurality of microchannels and a vibrating diaphragm that covers the microchannels. The vibrating diaphragm preferably comprises a piezoelectric actuator to vibrate the diaphragm, although other means for actuating the diaphragm to vibrate such as an electrostatic actuator, electromagnetic actuator, shape memory alloy and others can also be utilized instead of piezoelectric actuation. Electrodes are disposed on the surface of the diaphragm facing the microchannels to provide, when energized, an electrohydrodynamic (EHD) enhancement of fluid flow. Alternately or in addition, the electrodes may be disposed on side and/or bottom surfaces of the microchannels to this same end. The vibration motion on the fluid in combination with the EHD action on the fluid produce a synergistic effect that provides a higher fluid flow rate.

Another illustrative embodiment of the present invention provides a micropump that comprises a pumping chamber having a pumping diaphragm that alternately increases and decreases the volume of the pumping chamber to move a working fluid through an inlet nozzle-diffuser element in fluid communication with the pumping chamber and through an outlet nozzle-diffuser element in fluid communication with the pumping chamber. A plurality of electrodes are operatively associated with the micropump to provide, when energized, a traveling electric field through the working fluid to provide an electrohydrodynamic enhancement of the flow rate and hence the heat flux cooling of the micropump.

In further illustrative method and apparatus embodiments of the present invention, one or more of the above-described micropumps is/are connected to a heat-generating electronic component in thermal transfer relation to remove heat therefrom or are used to deliver a drug, medicine, chemical or other agent.

Advantages of the invention will become more readily apparent from the following description.

DESCRIPTION OF THE DRAWINGS

In FIG. 1, the diaphragm plate or sheet of the cooling system is omitted to show microchannel features.

In FIG. 9, the diaphragm plate or sheet of the cooling system is omitted to show microchannel features.

DESCRIPTION OF THE INVENTION

The present invention provides in an embodiment an electrohydrodynamic (EHD) micropump with fluid flow rate enhancement using a vibrating diaphragm, and useful for, although not limited to, removing heat from a heat-generating electronic component, such as for purposes of illustration and not limitation, a microelectronic IC chip (integrated circuit chip) of an electronic device such as cell phones, laptop computers, personal digital assistance devices, desktop computers, and the like as well as for delivering a drug, medicine or other treatment agent in or as a fluid to a patient. The micropump is advantageous in that it requires less space and electrical power as compared to a conventional micropumps and eliminates the need for an external pump for a microchannel heat sink, in that it provides increased and controllable volume flow rate of the working fluid, and in that it can be incorporated in a microchannel heat sink to provide an improved cooling system for heat-generating electronic components or in a delivery device to deliver a drug, medicine, chemical or other agent to a patient. Although the invention is described in detail in connection with micropumps for removing heat from a heat-generating microelectronic component, the invention is not so limited and can be used to deliver a drug, medicine, chemical or other agent in microdosing and/or microchemical applications, or to pump any fluid, either a liquid or a gas, from one location to another.

Figure 1:
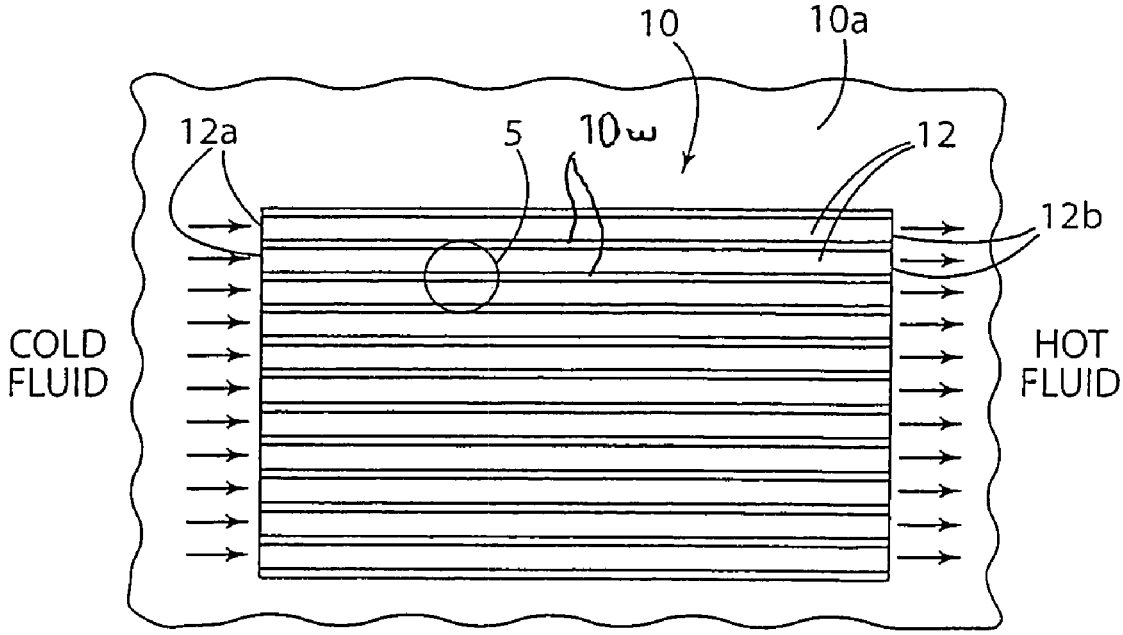
FIG. 1 is a plan view of a microelectronic chip substrate having a microchannel cooling system residing in thermal transfer manner on the chip.
Figure 2A:
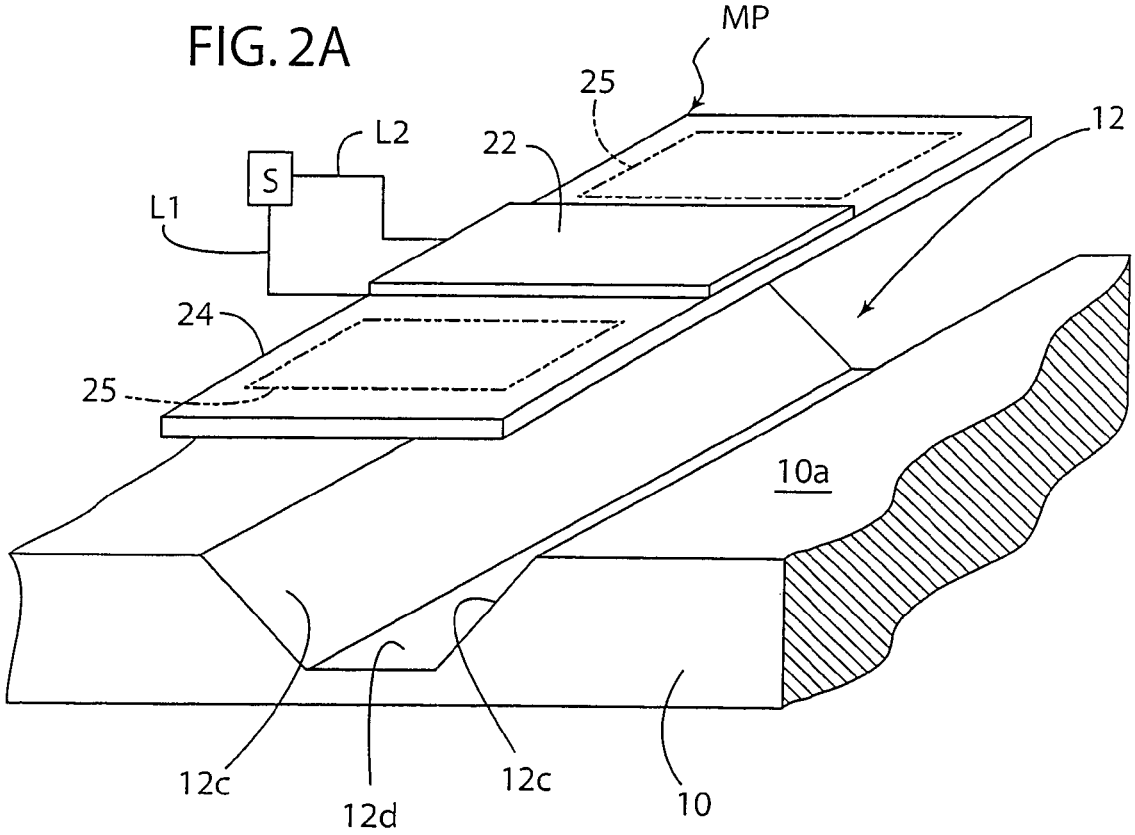
FIG. 2A is a schematic perspective view of an illustrative embodiment of the invention simplified to show a micropump having a single microchannel and vibrating diaphragm having electrodes on an underside thereof.

Referring to FIG. 1, heat-generating microelectronic chip substrate 10 (e.g. a silicon microelectronic chip) is shown having a surface 10*a* with a plurality of elongated microchannels 12 of a micropump formed to a depth therein so as to be in heat transfer relation with the chip substrate 10. Walls 10*w* of substrate 10 separate one microchannel from the next adjacent microchannel. FIG. 2A illustrates one of the microchannels 12 in more detail, the other microchannels being of like configuration.

The microchannels 12 each extend from a channel inlet 12*a* at an edge of the chip susbtrate 10 where the working fluid (such as for example water or any other gaseous or liquid fluid) enters for flow along the microchannel to a channel discharge or outlet 12*b* where working fluid that has absorbed heat from the microchannel cooling system is discharged. The microchannels 12 extend part way through the thickness of the chip substrate 10 such that the substrate itself forms facing inclined side walls 12*c* and a bottom wall 12*d* of each microchannel to provide a thermal transfer relation between the working fluid and the chip substrate 10. For purposes of illustration, the microchannels 12 typically each have a cross-sectional area of 50,000 microns$^2$ or less, such as from about 10 to about $6\times10^6$ microns$^2$. For purposes of further illustration and not limitation, the microchannels 12 can have an exemplary height of 500 microns and a width of 20 and 2,000 microns at the top of the microchannel for the trapezoidal channel shape shown in FIG. 2A.

The microchannels 12 preferably are formed integrally on the surface 10*a* of the chip substrate 10 using silicon micromachining processes, such as anisotropic wet etching, or other suitable fabrication processes. Alternately, the microchannels 12 can be formed in a separate body (not shown) that is joined to the heat-generating chip substrate 10 in a manner that provides heat transfer from the heat-generating chip substrate 10 to the separate body containing the microchannels. The surface 10*a* can be any appropriate surface of the heat-generating chip substrate 10 and is not limited to the upwardly facing surface 10*a* shown for purposes of illustration and not limitation in FIGS. 1 and 2A. Moreover, although the microchannels 12 are shown having a trapezoidal shape in FIG. 2A, the invention is not so limited as the microchannels 12 can have any appropriate shape including triangular, rectangular and others. The microchannels 12 preferably have a constant, uniform width dimension along their lengths.

Figure 2B:
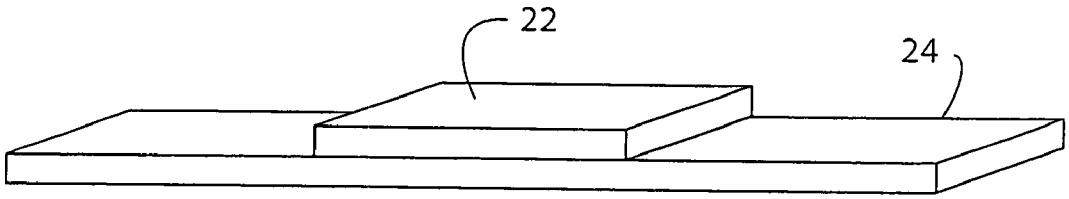
FIG. 2B is a perspective view of the diaphragm having a piezoelectric actuator on an upper side thereof.
Figure 2C:
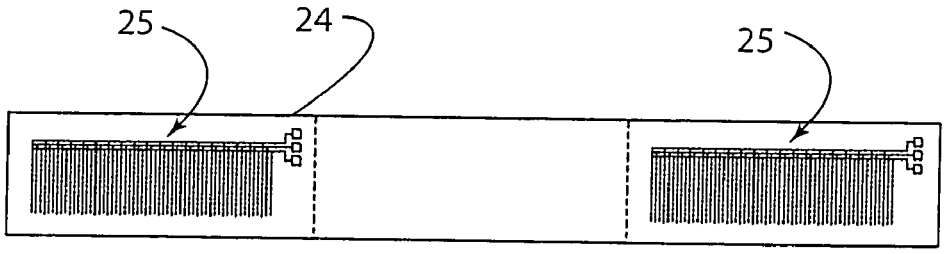
FIG. 2C is a view of the underside of the diaphragm showing the pattern of electrodes thereon.

FIGS. 2A, 2B and 2C illustrate a micropump MP pursuant to the invention comprising microchannel 12 and a vibratable diaphragm 24 that covers the microchannel 12 by closing off the open, upper side thereof as shown in FIG. 2A. Only a single microchannel 12 is shown in FIG. 2A for convenience, it being understood that typically a plurality of the microchannels 12 are employed (see FIG. 4) in conjunction with a vibratable diaphragm 24.

Referring to FIGS. 2A, 2B, and 2C, the vibratable diaphragm 24 includes a piezoelectric actuator element 22 on an upper side thereof to actuate the pumping diaphragm to vibrate to impart vibration to the bulk fluid in the microchannel 12. The piezoelectric element 22 is energized in a manner to cause the diaphragm to vibrate (e.g. at about 10 kHz) to this end. The piezoelectric element 22 may comprise preformed disk(s) bonded to the upper side of the diaphragm 24 or deposited on the upper side of the diaphragm 24.

For purposes of illustration and not limitation, the diaphragm 24 can comprise sheet or plate of suitable material of a size to cover all of the microchannels 12 and can be glued or otherwise attached (e.g. bonded) to the border of the upwardly facing side 10*s* of the chip substrate 10 to this end. Further, the sheet or plate can comprise silicon, glass or other suitable material while the piezoelectric material can comprise PZT (lead zirconate titanate) material deposited on the sheet or plate by a screen printing process. The sheet or plate can have a thickness of about 1 millimeter for purposes of illustration and not limitation, although other sheet thicknesses of the vibratable diaphragm can be used in practice of the invention.

Each piezoelectric element 22 includes electrodes (not shown) in the form of a coating of a metal such as Ni, Ag and the like that are disposed on the top and bottom of the element 22 and that are connected by lead wires L1, L2 to a conventional electrical power source (drive circuit) S which actuates the piezoelectric element 22 with a periodic alternating voltage signal at a frequency to drive the diaphragm 24 to vibrate at or near resonance (of the pumping diaphragm and the bulk fluid mass in the microchannel), although the piezoelectric elements 22 can be driven at any suitable frequency of oscillation (e.g. 10-15 KHz for purposes of illustration and not limitation) depending upon the magnitude (amplitude) of the periodic alternating voltage signal and vibration characteristics of the diaphragm 24.

The invention is not limited to use of piezoelectric element 22 to vibrate the diaphragm 24 and envisions other means for actuating the diaphragm. For purposes of illustration and not limitation, an electrostatic actuator, electromagnetic actuator, shape memory alloy, and other means can be utilized to actuate the diaphragm.

Figure 12:
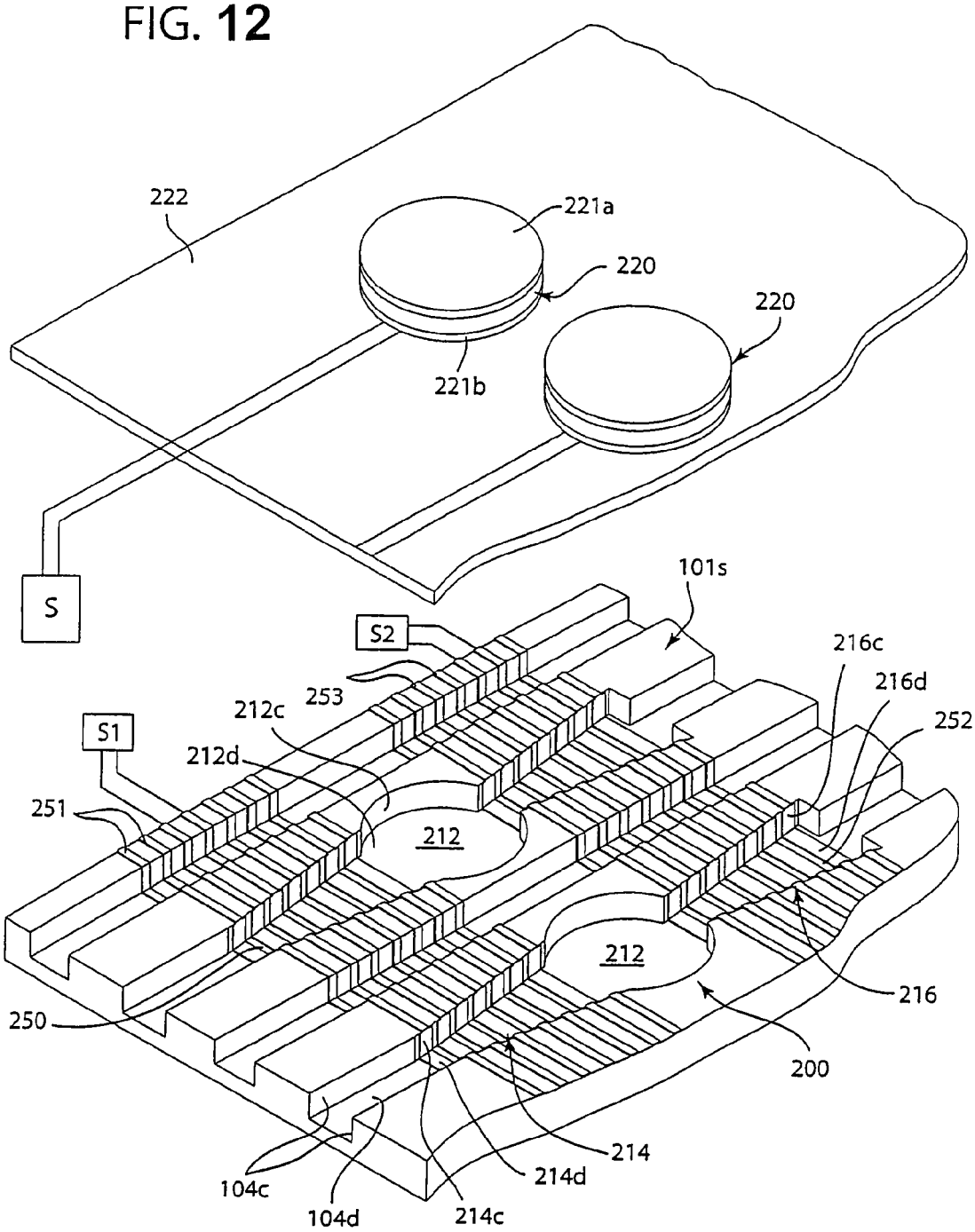
FIG. 12 is an enlarged exploded view of the microchannel cooling system employing valveless micropumps with nozzle-diffuser elements.

Sets 25 of electrodes are disposed on the underside of the diaphragm 24 as shown in FIGS. 2A and 2C facing the microchannel 12 to provide, when energized, an electrohydrodynamic enhancement of flow rate of the working fluid flowing through the microchannels. The sets 25 of the electrodes are disposed on opposite regions of the underside of the diaphragm 24 relative to the element 22; there are may or may not be electrodes disposed under the piezoelectric element 22. Alternately or in addition, the electrodes may be operatively associated with side and/or bottom surfaces of the microchannel 12 itself to this same end as shown in FIG. 12 for example with respect to another embodiment of the invention.

Figure 6:
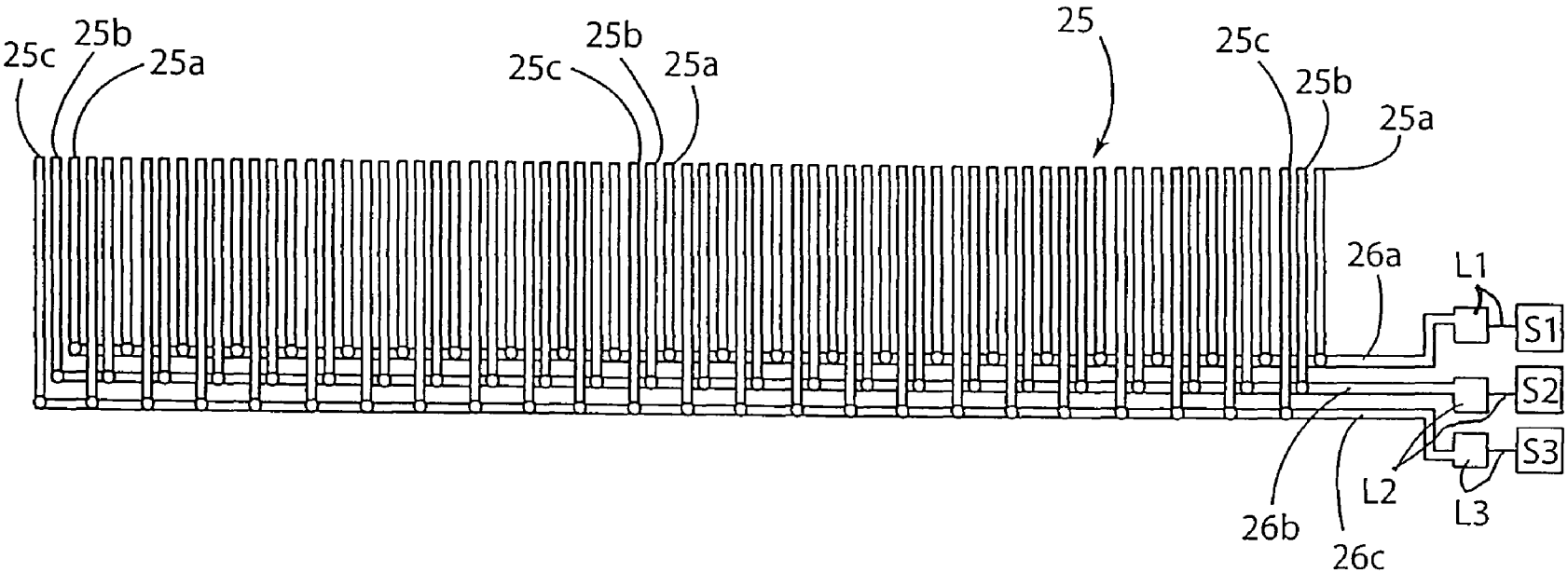
FIG. 6 is an enlarged view of a set of the electrodes.

Each electrode set 25 can be configured as shown in FIG. 6 to comprise repeating series of electrodes 25*a*, 25*b*, 25*c* arranged in succession along the length of the microchannel 12 and connected to respective bus bars 26*a*, 26*b*, and 26*c*. Any number of repeating electrodes in each series can be employed along the length of the microchannel in practice of the invention. The electrodes and the bus bars are deposited on the underside of the pumping diaphragm 24 by conventional chemical or physical evaporation/deposition processes employed to form aluminum strip electrodes and bus bars using standard lithography techniques. The electrodes 25*a*, 25*b*, 25*c* extend in a direction transverse, such as perpendicular, to the flow of the working fluid through the microchannel 12.

The number and spacing of the electrodes 25*a*, 25*b*, 25*c* as well as excitation voltage and frequency are chosen as desired to achieve a desired electrohydrodynamic pumping action of the working fluid. For example, when heat is being removed from the microelectronic chip substrate 10 in operation, the working fluid present in the microchannels 12, will experience a temperature gradient across the height or depth dimension thereof. This temperature gradient will cause a gradient in the electrical conductivity and permittivity of the working fluid in the microchannels 12. When an alternating voltage is applied to the electrodes 25, a traveling electric field is generated through the working fluid in the microchannel. The traveling electric field waves will induce electric charges in the bulk of the working fluid therein. Depending on the speed of the traveling waves, these charges will be slightly displaced in the horizontal direction (also the vertical direction) due to charge relaxation and hence interact with the traveling electric field waves. The interaction will cause the application of Coulomb forces on the charges, causing a pressure gradient in the microchannel that imparts flow to the fluid therein. For example, these moving charges will carry the bulk working fluid with them due to viscous effects, leading to an electrohydrodynamic pumping action. The number and spacing of the electrodes 25*a*, 25*b*, 25*c* can be chosen as desired to achieve a desired pumping action of the working fluid.

The electrodes 25*a*, 25*b*, 25*c* are connected by leads L1, L2, and L3 to respective connection terminals S1, S2, S3 of a three-phase alternating voltage source (power supply) and energized in a manner at appropriate voltages and/or times to establish the traveling electric fields in the working fluid in the microchannel 12. Both sets 25 of electrodes can be connected to the same three-phase alternating voltage source via similar leads or to separate power supplies. Application of multi-phase alternating voltage to series of parallel electrodes results in creation of a traveling electric field. The voltage amplitude and frequency may be about 100 V and about 20 to 30 kHz provided to the electrodes for purposes of illustration and not limitation. The number of electrical phases can be 2, 3, 4 or any other higher number.

Figure 3:
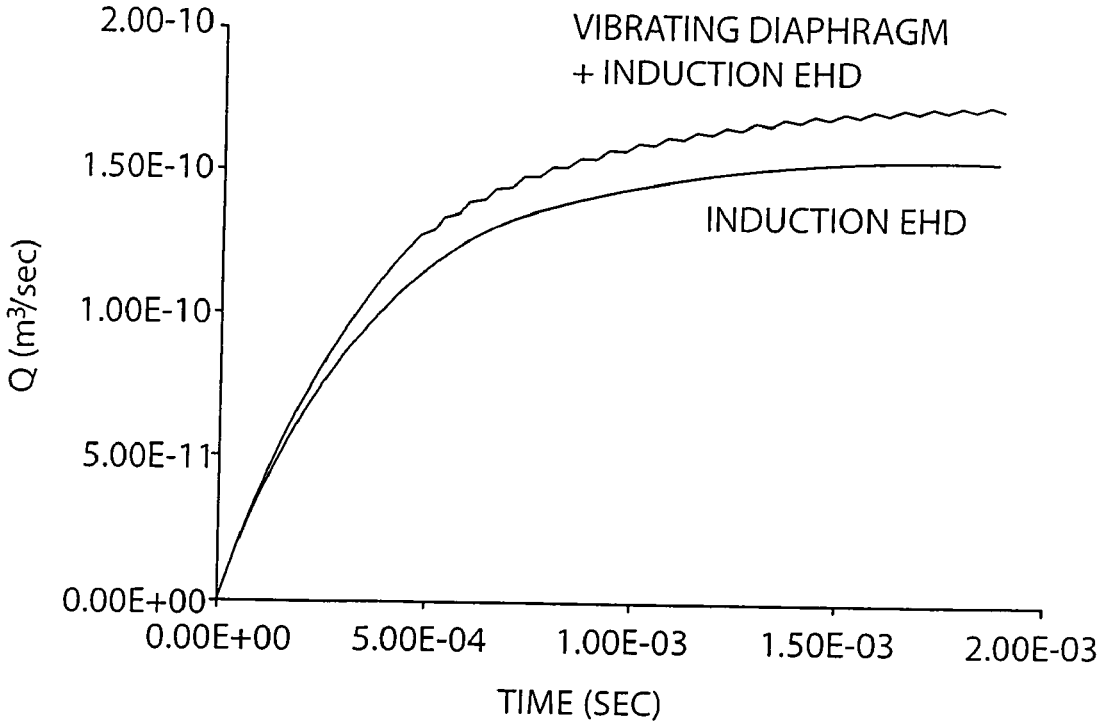
FIG. 3 is a graph of net flow rate until steady state flow versus time in seconds with the net flow rate. One graph depicts net flow rate versus time of the micropump with the diaphragm vibrated and the electrodes energized. The other graph depicts net flow rate versus time of the micropump with the electrodes energized but with the diaphragm not vibrated. Vibration of the diaphragm without the electrodes energized would cause zero net flow.

Referring to FIG. 3, computer simulation results for the micropump of FIGS. 2A, 2B, and 2C are shown. For all the simulations, the frequency and the amplitude of the vibrating diaphragm 24 was fixed at 10 KHz and 0.1 micron, respectively. The electrode sets 25 were placed all along the length of the diaphragm 24 except for the region below the piezoelectric element 22, FIG. 2C. The vibrating diaphragm had a width of 200 microns and a thickness of 50 microns and was made of silicon material. The piezoelectric element 22 had a width of 200 microns and a length of 500 microns, while the regions of the diaphragm 24 on each side the piezoelectric element each had a length of 500 microns, providing a total length of the vibrating diaphragm of 1500 microns. Both the width of the electrodes 25*a*, 25*b*, 25*c* and the spacing between the electrodes was 20 microns, the width and spacing being in the same direction as the long axis of the microchannel. A three phase potential wave of amplitude 200V and frequency of 122 kHz was applied to the electrodes 25*a*, 25*b*, and 25*c* with the three phases being out of phase by 120 degrees. If the electrodes are spaced equally apart and 3 or more phase alternating voltage is used, the phase difference between adjacent electrodes should be equal. This would lead to highest flow rate. For 3-phase this would be 120° (=360°/3), and for 4-phase this would be 90° (=360°/4). However, if a 2-phase power supply is used, either the distance between adjacent electrodes or the phase-difference between potential at adjacent electrodes should be unequal, otherwise a traveling electric wave would not be created.

The net flow rates of a working fluid (selected to be deionized water with KCl mixed to increase electrical conductivity) due to the action of the induction electrohydrodynamic (EHD) action alone and that from the combined action of the vibrating diaphragm 24 plus induction EHD are shown in FIG. 3 until the flow reached almost steady-state.

It is apparent that the fluid flow due to the action of the vibrating diaphragm 24 alone causes a sinusoidal flow variation, even though the net flow from the vibrating diaphragm is zero. Flow rate due to the combined action of the vibrating diaphragm 24 and induction EDH is 12% higher ($1.75\times10^{-10}$ $m^3$/sec) than flow rate due to induction EHD alone ($1.55\times10^{-10}$ $m^3$/sec). The increase is due to the increase in the output of the EHD action, which is due to combined effect of increase in efficiency of induction EHD and increase in power output from the electrodes. If the micropump of FIG. 2A is integrated into multiple microchannels 12 on a chip substrate having an area of 1 cm by 1 cm wherein each microchannel has a width of 50 microns at the top, a flow rate of $1.75\times10^{-10}$ $m^3$/sec corresponds to a total flow rate of 2.24 ml/min for the 1 cm by 1 cm chip substrate.

Figure 5:
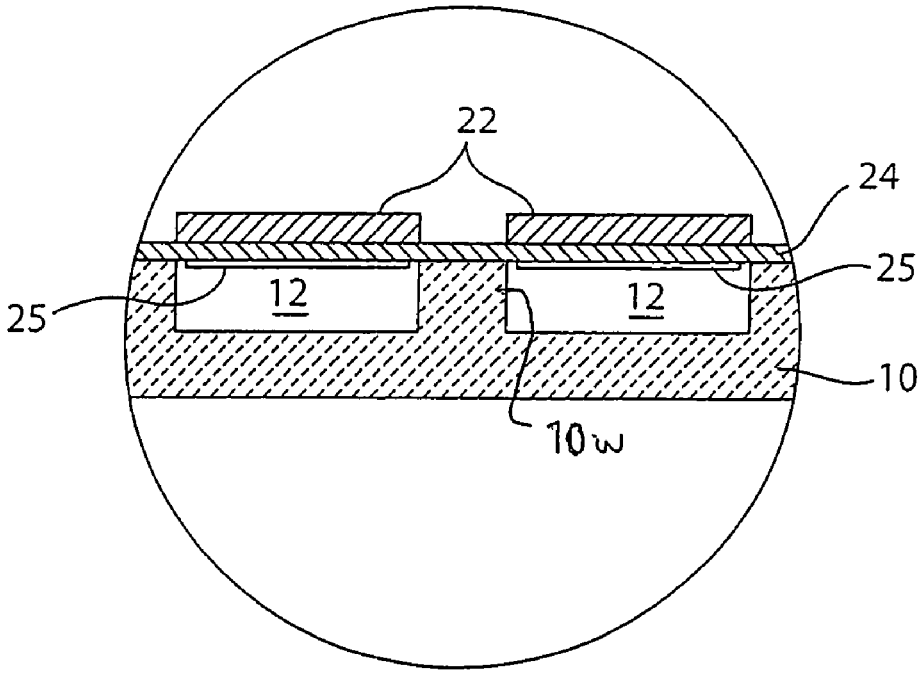
FIG. 5 is a partial cross sectional view taken along lines 5-5 of FIG. 4.
Figure 4:
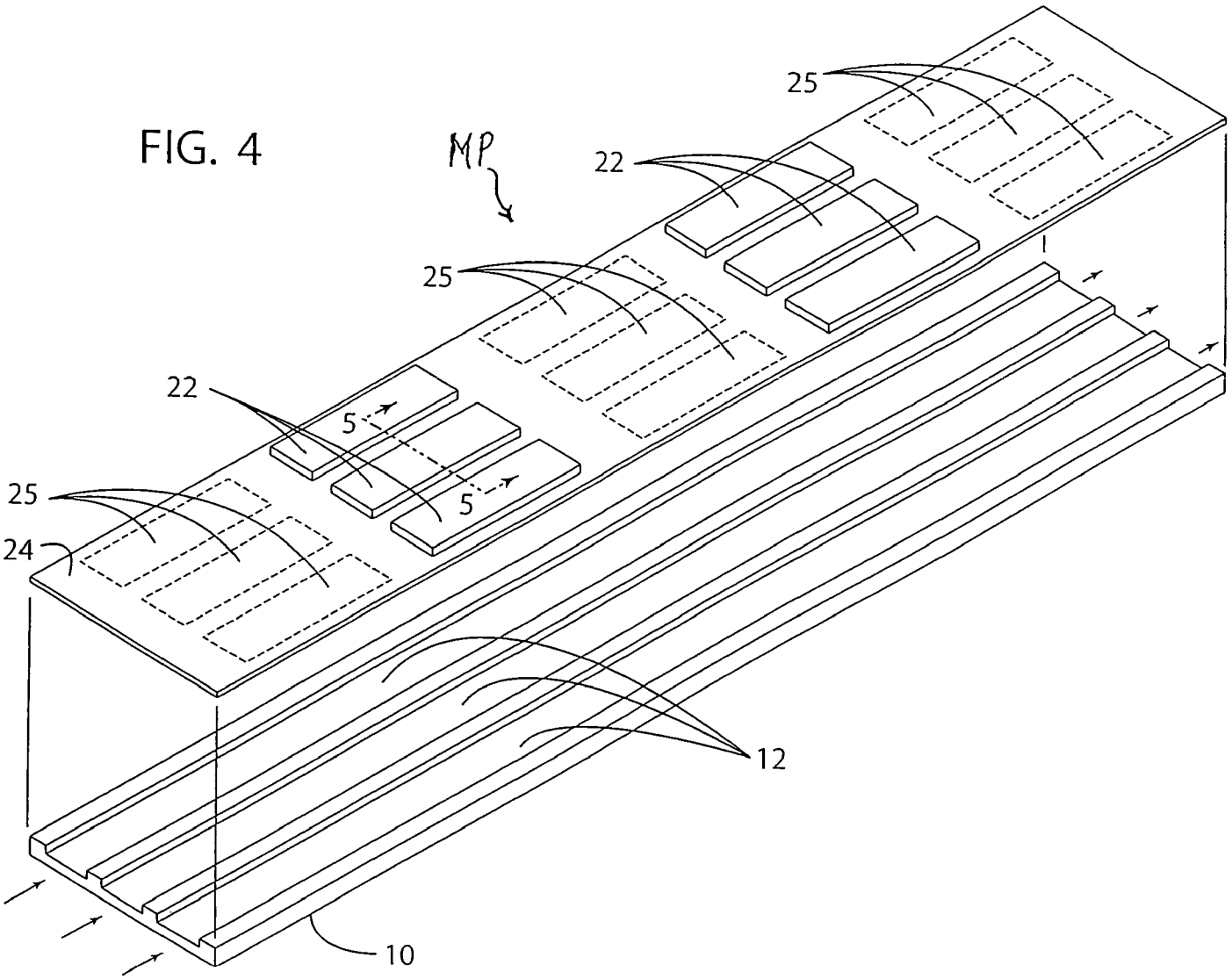
FIG. 4 is an exploded perspective view of a micropump pursuant to an embodiment of the invention comprising a plurality of microchannels and a vibrating diaphragm having a plurality of piezoelectric actuators and electrodes along the length of each microchannel.

FIGS. 4 and 5 illustrate a micropump pursuant to an embodiment of the invention derived from FIG. 2A. The micropump MP comprises a plurality of microchannels 12 formed in a chip substrate 10 and a vibrating diaphragm 14 closing off the microchannels and adhered to the edge borders of the chip substrate. The microchannels 12 have a rectangular shape rather than a trapezoidal shape. The diaphragm 24 includes a plurality of piezoelectric elements 22 spaced apart on the upper side thereof along the length of the diaphragm and multiple sets 25 of electrodes of the type shown in FIG. 6 disposed on opposite sides of the elements 22 along the length of each microchannel. The piezoelectric elements 22 are energized to vibrate the diaphragm and thus impart vibration motion to the bulk fluid in the microchannels while the sets 25 of electrodes establish an EHD action as described above to enhance fluid flow through the microchannels.

Figure 7:
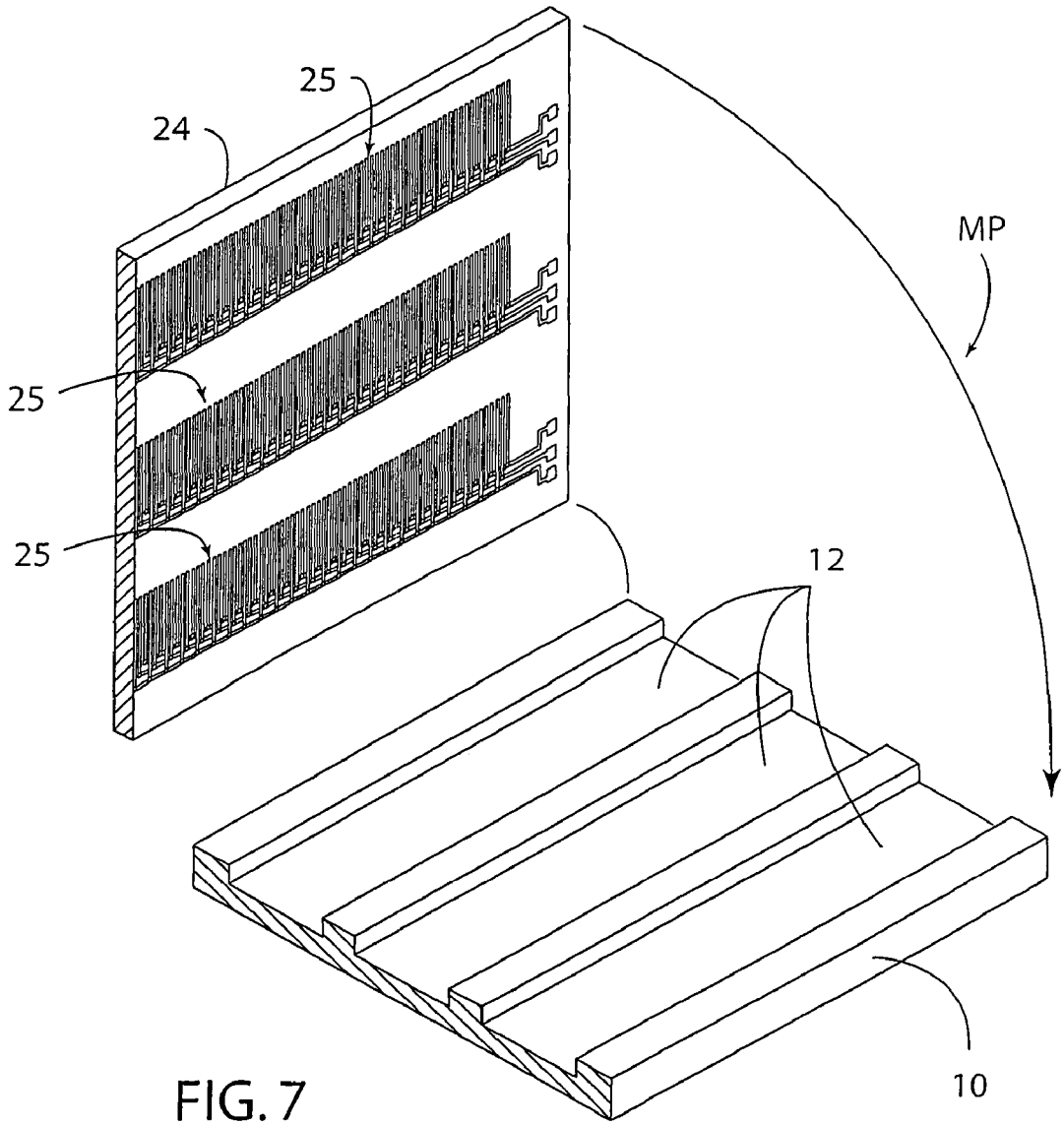
FIG. 7 is an exploded perspective view of a micropump pursuant to another embodiment of the invention comprising a plurality of microchannels and a vibrating diaphragm having a plurality of electrodes along the length of each microchannel.

FIG. 7 illustrates a micropump pursuant to another embodiment of the invention derived from FIG. 2A. The micropump MP comprises a plurality of microchannels 12 formed in a chip substrate 10 and a vibrating or non-vibrating diaphragm 14 closing off the microchannels and adhered to the edge borders of the chip substrate. The microchannels 12 have a rectangular shape rather than a trapezoidal shape. The diaphragm 24 includes sets 25 of electrodes of the type shown in FIG. 6 disposed on an underside thereof facing the microchannels 12 and extending along the length of each underlying microchannel 12. The embodiment of FIG. 7 omits the piezoelectric elements on the upper side of the diaphragm as in FIGS. 4 and 5 and thus relies on EHD action alone to induce flow of the fluid through the microchannels.

In the embodiments described above and below, the fluid can be provided to the inlets 12*a* of the microchannels 12 with a pressure head to further enhance fluid flow through the microchannels 12. A conventional external or integrated fluid pump P can be used to drive the fluid through the microchannels to channel outlet 12*b* where the fluid is discharged to an external heat exchanger (not shown) and then circulated back into the inlets 12*a* of the microchnnels in closed loop manner, if desired, or to atmosphere in open loop manner in the event that air is the fluid. For fluid delivery such as would be used to deliver a drug, medicine, or other treatment agent to a patient, the fluid would simply be discharged from the microchannel outlets 12*b* for delivery to the patient. Conventional inlet and outlet manifolds/plenums having fluid supply and discharge ports in communication to inlets and outlets 12*a* and 12*b*, respectively, and forming no part of the invention can be included to reduce maldistributon of fluid flow.

Figure 8A:
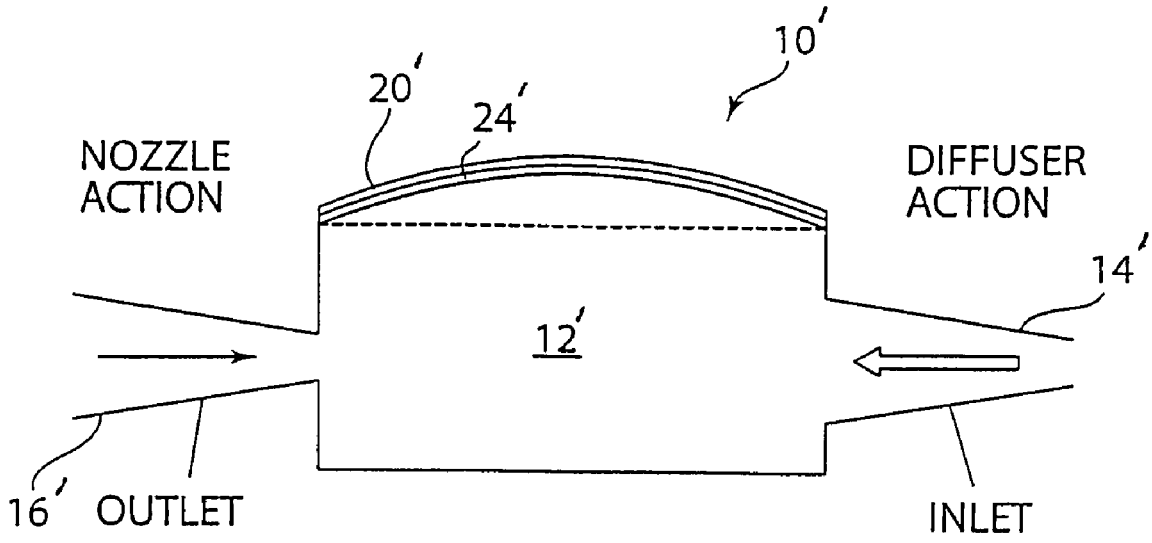
FIG.8A PRIOR ART
FIGS. 8A and 8B are schematic views of a conventional valveless micropump with nozzle-diffuser elements showing the principle of operation when the volume of the pumping chamber is relatively increased, FIG. 8A, and then relatively decreased, FIG. 8B.
Figure 8B:
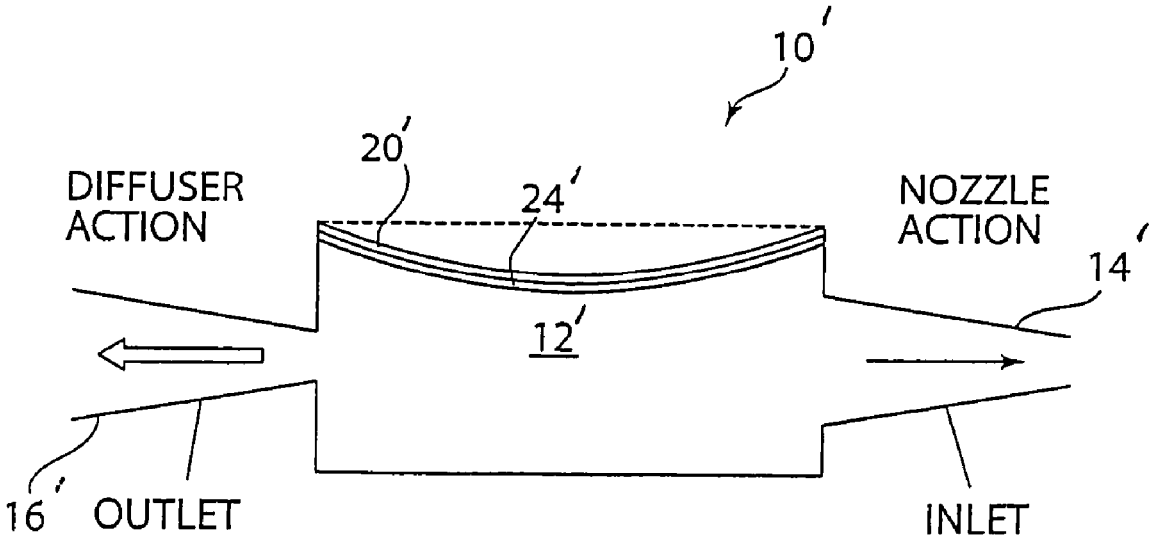
FIG.8B PRIOR ART

Referring to FIGS. 8A and 8B, operation of a conventional valveless nozzle-diffuser pump 10' is shown for purposes of understanding still another embodiment of the present invention described below. A valveless nozzle-diffuser pump is described by Stemme et al. in "A valveless diffuser/nozzle-based fluid pump", Sensors and Actuators A: Physical, Vol. 39, pp. 159-167, 1993.

The pump 10' comprises a pumping chamber 12' in fluid flow communication to an inlet nozzle-diffuser element 14' and an outlet nozzle-diffuser element 16'. A vibratable diaphragm 24' is provided in the pumping chamber and has a piezoelectric material 20' on one or more sides, which is energized in a manner to cause the diaphragm to vibrate (e.g. at about 10 kHz) in an expansion mode shown in FIG. 8A and in a contraction mode shown in FIG. 8B. The piezoelectric material 20' may comprise preformed disk(s) bonded to one or more sides of the diaphragm 24' or deposited on one or more sides of the diaphragm 24'. The expansion mode increases the volume of the pumping chamber 12', while the contraction mode decreases the volume of the pumping chamber. When the volume of the pumping chamber 12' increases, the pressure in the pumping chamber decreases and more working fluid (e.g. air or other gas or liquid) enters through the inlet nozzle-diffuser element 14' relative to that entering the pumping chamber through the outlet nozzle-diffuser element 16'. Conversely, when the volume of the pumping chamber 12' decreases, more working fluid exits the diverging outlet nozzle-diffuser element 16' of the pump. A net pumping action is provided from right to left in FIG. 1B out of the outlet nozzle-diffuser element 16' of the pump where the thicker arrow represents higher volume flow rate of the working fluid.

The ability of the pump to direct flow in one preferential direction (e.g. the outlet direction) can be expressed in terms of the flow direction (rectification) efficiency, $\epsilon$, as:

$$\epsilon=(Q_+-Q_-)/(Q_++Q_-)$$

in which $Q_+$ and $Q_-$ are the volumes of fluid moving through both the nozzle-diffuser elements 14', 16' in the diffuser direction and nozzle direction, respectively. A higher $\epsilon$ corresponds to better flow rectification, with $\epsilon=1$ implying perfect flow rectification. For a given design of the pump, the flow rate of the pump will depend on the value of $\epsilon$. Typical values of $\epsilon$ of 0.01 to 0.2 have been reported for conventional valveless micropumps.

Figure 10:
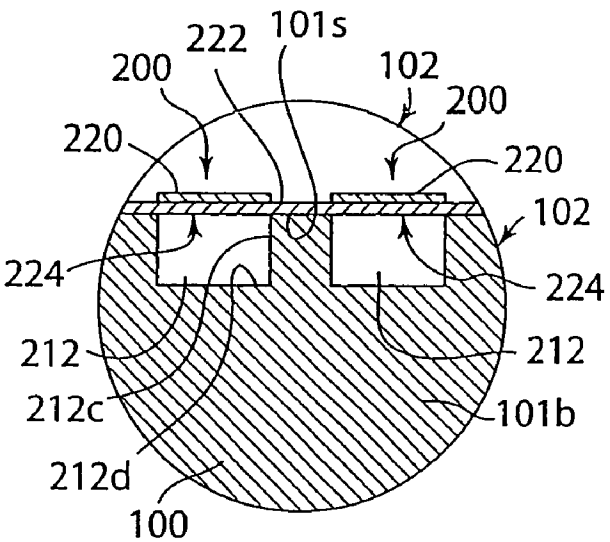
FIG. 10 is an enlarged sectional view of the microchannel cooling system at the encircled area of FIG. 9.
Figure 9:
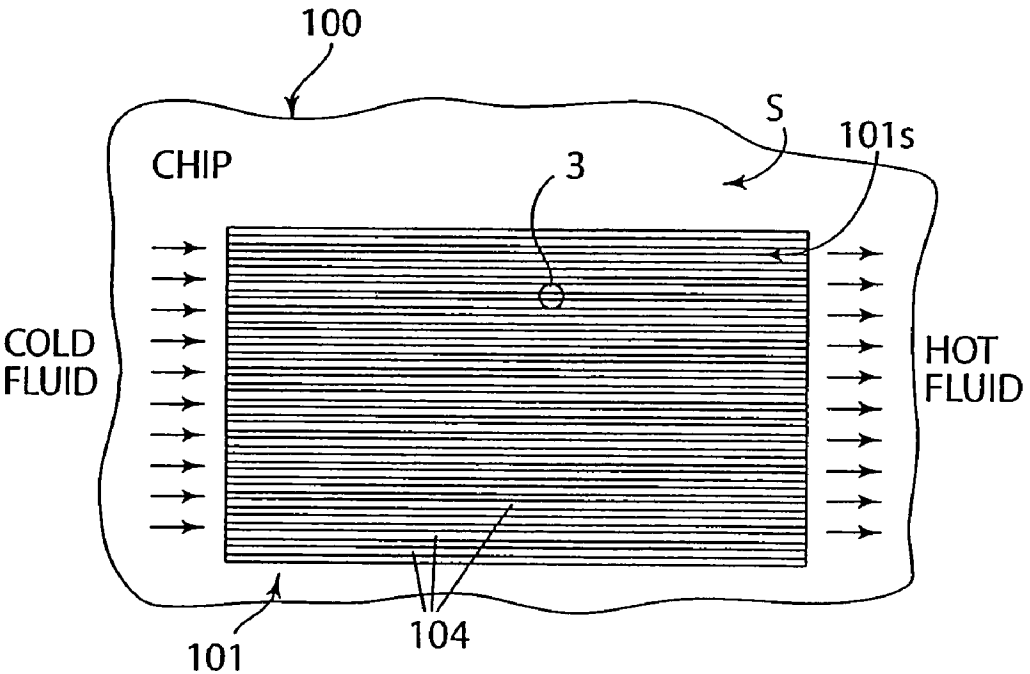
FIG. 9 is a plan view of an electronic chip having a microchannel cooling system shown in cross-section pursuant to an illustrative embodiment of the invention residing in thermal transfer manner on the chip.

Referring to FIG. 9, a heat-generating microelectronic chip 100 is shown having a microchannel cooling system 101 pursuant to an illustrative embodiment of the invention thereon. The microchannel cooling system 101 is shown in FIG. 9 as having a planar or plate-like configuration oriented parallel with the upwardly facing surface S of the chip 100, although the microchannel cooling system may have any suitable configuration and orientation and may reside in thermal transfer relation on any available surface of the chip 100. The microchannel cooling system 101 preferably is formed integrally on the upwardly facing (or other) surface S of the chip 100 using silicon micromachining processes or other suitable fabrication processes. The microchannel cooling system 101 is shown in FIG. 10 including an upwardly facing surface 101*s* formed on a thermally conductive body 101*b* of the microchannel cooling system, although the invention is not limited to such an upwardly facing surface. Alternately, the microchannel cooling system 101 can be formed as a separate body 101*b* that is joined to the chip 100 in a manner that provides heat transfer from the heat-generating chip 100 to the body 101*b* of the microchannel cooling system.

Figure 11:
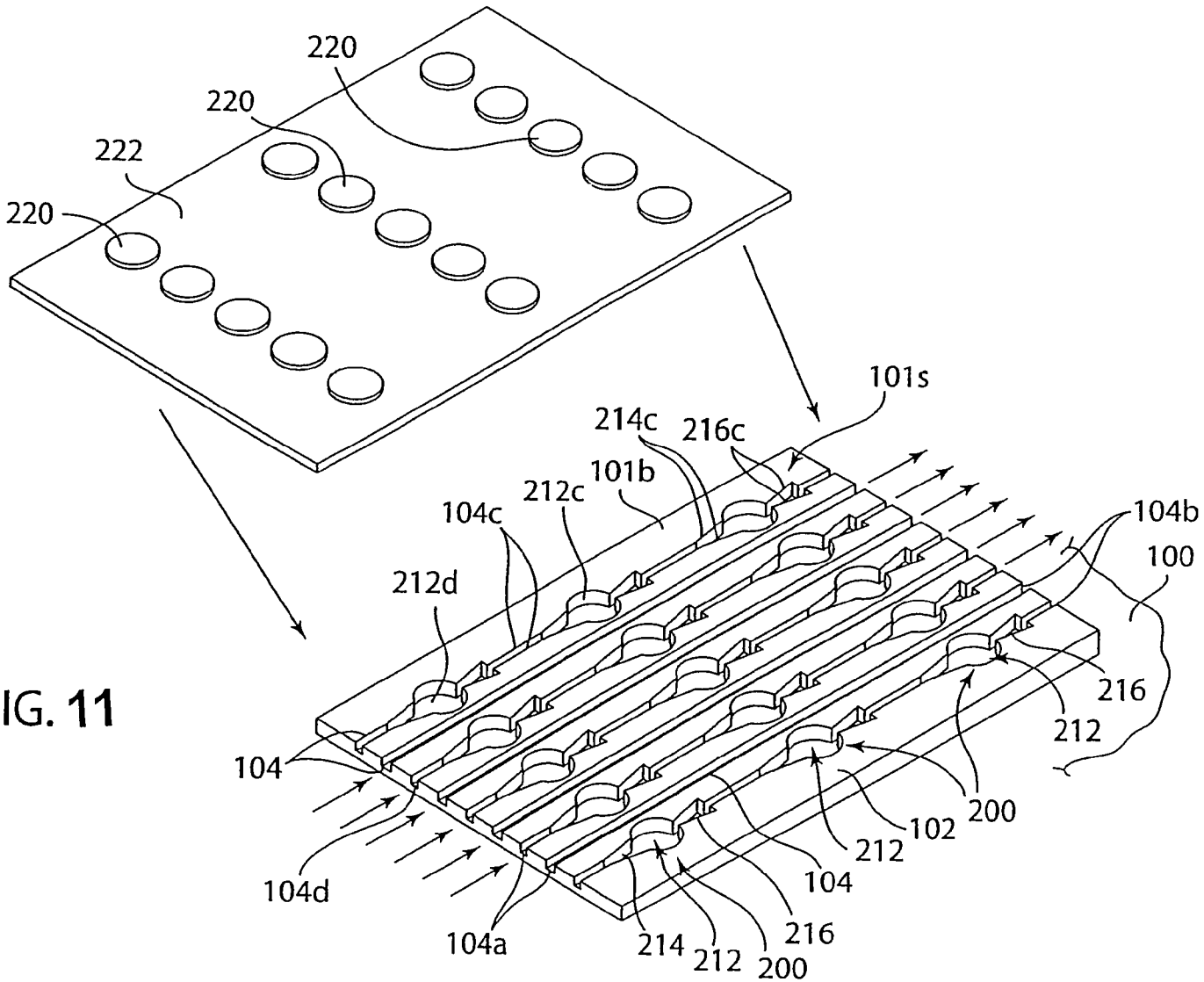
FIG. 11 is an exploded view of a microchannel cooling system employing valveless micropumps with nozzle-diffuser elements showing multiple microchannels and multiple micropumps pursuant to an illustrative embodiment of the invention residing in each microchannel and a diaphragm sheet for positioning on the microchannel cooling system.

Pursuant to an illustrative embodiment of the invention and referring to FIGS. 11 and 12, the microchannel cooling system 101 includes at least one, preferably a plurality, of microchannels 104 and at least one, preferably a plurality, of micropumps 200 residing in the microchannels 104 to pump air or other gaseous or liquid (e.g. water) working fluid through the microchannels from the inlet ends 104*a* to the outlet ends 104*b* thereof to remove heat generated by the chip 100. In FIG. 9, the microchannels 104 are shown schematically as straight channels without the presence of the micropumps 200 for the sake of convenience, it being understood that the actual microchannels 104 have the micropumps 200 residing therein as shown in more detail in FIGS. 4 and 5. In FIGS. 11 and 12, some microchannels 104 are shown without micropumps 220 therein for sake of convenience. Typically, most or all of the microchannels 104 will be provided with micropumps 220 therein, although the invention is not limited in this regard.

The microchannels 104 each extend from the channel inlet 104*a* at an edge of the microchannel cooling system 101 where working fluid (such as for example air or any other gaseous or liquid fluid) enters for flow along the microchannel to a channel discharge or outlet 104*b* where working fluid that has absorbed heat from the microchannel cooling system is discharged. The microchannels 104 extend part way through the thickness of the thermally conductive body 101*b* of the microchannel cooling system such that the thermally conductive body 101*b* forms facing side walls 104*c* and a bottom wall 104*d* of each microchannel to provide a thermal transfer relation between the microchannels 104 of the body 101*b* and the heat-generating component 100. For purposes of illustration, the microchannels 104 typically have a cross-sectional dimension of 50,000 microns$^2$ or less, such as from 10 to about $6\times10^6$ microns$^2$. For purposes of further illustration and not limitation, the microchannels 104 can have an exemplary depth of 500 microns and a width of 100 microns. Although the microchannels 104 are illustrated as having a rectangular cross-sectional shape, they can have any suitable other cross-sectional shape.

Referring to FIGS. 11 and 12, a plurality (three shown in FIG. 11) of valveless micropumps 200 are shown residing in series arrangement in each microchannel 104 pursuant to an embodiment of the invention offered for purposes of illustration and not limitation. For example, each microchannel 104 is shown including three micropumps 200 spaced apart along the length of the microchannel. Each micropump 200 comprises a cylindrical (or other shape) pumping chamber 212 formed in the body 101*b* as well as an inlet nozzle-diffuser channel element 214 and an outlet nozzle-diffuser channel element 216, both in communication with the pumping chamber 212. The outlet nozzle-diffuser channel element 216 is illustrated as being disposed on the opposite diametric side of the pumping chamber 212 from the inlet nozzle-diffuser channel element 214. Each pumping chamber 212 extends part way through the thickness of the thermally conductive body 101*b* such that the body 101*b* forms the side wall 212*c* and a bottom wall 212*d* of each pumping chamber, FIG. 3. Each inlet nozzle-diffuser channel element 214 extends part way through the thickness of the thermally conductive body 101*b* such that the body 101*b* forms facing side walls 214*c* and a bottom wall 214*d* of each inlet nozzle-diffuser channel element. Each outlet nozzle-diffuser channel element 216 extends part way through the thickness of the thermally conductive body 101*b* such that the body 101*b* forms facing side walls 216*c* and a bottom wall 216*d* of each outlet nozzle-diffuser channel element. The inlet nozzle-diffuser element 214 has a tapered configuration with a cross-sectional dimension that increases in a direction toward the pumping chamber 212. The outlet nozzle-diffuser element 216 has a tapered configuration with a cross-sectional dimension that increases in a direction away from the pumping chamber 212.

For purposes of illustration and not limitation, for a microchannel 104 having the above-described exemplary depth and width, the pumping chamber 212 and the inlet and outlet channel elements 214, 216 can have the same depth as the microchannel 104. For purposes of illustration and not limitation, the minimum width of each of the inlet and outlet nozzle-diffuser channel elements 214, 216 generally is equal to the width of the microchannels 104 interconnecting them while the maximum width of each of the inlet and outlet channel elements 214, 216 can be 300 microns. The diameter of each pumping chamber 212 can be in the range of 300 to 1000 microns for purposes of illustration and not limitation. The inlet and outlet channel elements 214, 216 can have any suitable cross-sectional shape and dimensions depending upon the fluid flow rates desired.

As is apparent from FIG. 11, the microchannel cooling system 101 is illustrated as including five parallel microchannels 104 each having three micropumps 200 arranged in series in each microchannel. However, any number and arrangement of microchannels 104 and micropumps 200 can be provided. In FIG. 11, the flow of cold working fluid through the microchannels 104 is illustrated by arrows as being from left to right such that the working fluid removes heat from the thermally conductive body 101*b* and exits the microchannels 104 as hot or heated working fluid to be exhausted to an external heat exchanger (not shown) and then circulated back into the microchannel cooling system, if desired.

The microchannels 104, pumping chambers 212, inlet channel element 214, and outlet channel element 216 can be formed in the thermally conductive body 101*b* by conventional silicon micromachining processes, such as for example deep reactive ion etching when body 101*b* comprises silicon or by mechanical machining processes, such as for example electrical discharge machining, when body 101*b* comprises a thermally conductive metal such as aluminum, or by any other suitable machining process.

A plurality of piezoelectric disk-shaped elements 220 are disposed on a diaphragm sheet or plate 222 that is placed on the upwardly facing side 101*s* of the thermally conductive body 101*b* such that a respective piezoelectric disk-shaped element 220 overlies a respective one of the pumping chambers 212, closing off each pumping chamber 212 and providing a pumping diaphragm region 224 of sheet 222 in each pumping chamber. Other regions of the sheet or plate 222 close off the microchannels 104 and the inlet and outlet nozzle-diffuser channel elements 214, 216. For purposes of illustration and not limitation, the sheet or plate 222 can be glued or otherwise attached (e.g. bonded) to the upwardly facing side 101*s* of the thermally conductive body 101. Further, the sheet or plate 222 can comprise silicon, glass or other suitable material while the piezoelectric material can comprise PZT (lead zirconate titanate) material deposited on the sheet or plate by a screen printing process. The sheet or plate 222 can have a thickness of about 1 millimeter for purposes of illustration and not limitation, although other sheet thicknesses can be used in practice of the invention.

Each vibrating diaphragm region 224 overlies a respective one of the pumping chambers 212. Each piezoelectric element 220 on the diaphragm is electrically energized to actuate each diaphragm to vibrate in an expansion mode and contraction mode to increase or decrease the volume of the pumping chamber 212 as described above to move the working fluid along the length of the microchannels 104. The piezoelectric elements 220 each includes electrodes 221*a*, 221*b* in the form of a coating of a metal such as Ni, Ag and the like on the outer side and inner side of each piezoelectric element 220. The electrodes typically overlie the entire outer and inner sides of the piezoelectric elements 220, although the invention is not so limited. The electrodes are connected to a conventional electrical power source (drive circuit) S which actuates the piezoelectric elements 220 with a periodic alternating voltage signal at a frequency to drive the pumping diaphragm regions 224 at or near resonance (of the pumping diaphragm and the fluid mass in the pumping chamber), although the piezoelectric elements 220 can be driven at any suitable frequency of oscillation (e.g. 10-15 KHz for purposes of illustration and not limitation) depending upon the magnitude (amplitude) of the periodic alternating voltage signal and vibration characteristics of the pumping diaphragm 224. Some of the piezoelectric elements 220 will be driven in-phase (in unison) while others will be driven out of phase (not in unison) to achieve desired working fluid flow rate and pressure head.

Pursuant to an illustrative embodiment of the invention, a plurality of conductive metallic electrodes 250, 252 are operatively associated with the respective inlet nozzle-diffuser channel element 214 and the outlet nozzle-diffuser channel element 216, respectively, of each micropump 200. For example, strip electrodes 250 are vapor deposited on the side walls 214*c* and bottom wall 214*d* of each inlet nozzle-diffuser channel element 214. Strip electrodes 252 are deposited on the side walls 216*c* and bottom wall 216*d* of each outlet nozzle-diffuser channel element 216. The strip electrodes 250, 252 extend in a direction perpendicular to the flow of the working fluid through the channel elements 214, 216. The electrodes 250, 252 are deposited in the inlet and outlet nozzle-diffuser channel elements 214, 216 by for example chemical or physical vapor deposition processes.

The electrodes 250, 252 in another alternate embodiment of the invention can be provided on the pumping diaphragm regions 224 and aligned with the respective inlet and outlet channel elements 214, 216. Furthermore, similar electrodes may be provided in the pumping chambers 212 and in the sections of the microchannels 104 interconnecting adjacent micropumps 200 in each respective microchannel 104.

The number and spacing of the electrodes 250, 252 in the inlet and outlet nozzle-diffuser channel elements 214, 216 as well as excitation voltage and frequency are chosen as desired to achieve a desired electrohydrodynamic and/or electro-osmotic pumping action of the working fluid in addition to the pumping action provided by the vibrating pumping diaphragm regions 224. For example, when heat is being removed from the microelectronic chip 100 in operation, the working fluid present in the microchannels 104, pumping chambers 212, and inlet and outlet nozzle-diffuser channel elements 214, 216 will experience a temperature gradient across the height or depth dimension thereof. This temperature gradient will cause a gradient in the electrical conductivity and permittivity of the working fluid in the microchannels 104 and inlet and outlet nozzle-diffuser channel elements 214, 216. When an alternating voltage is applied to each set of electrodes 250, 252, a traveling electric field is generated through the working fluid in the inlet and outlet nozzle-diffuser channel elements 214, 216. The traveling electric field waves will induce electric charges in the bulk of the working fluid therein. Depending on the speed of the traveling waves, these charges will be slightly displaced in the horizontal direction (also the vertical direction) due to charge relaxation and hence interact with the traveling electric field waves. The interaction will cause the application of Coulomb forces on the charges, causing a pressure gradient in the inlet and outlet channel elements 214, 216 that increases rectification efficiency, $\epsilon$, of the micropumps. For example, these moving charges will carry the bulk working fluid with them due to viscous effects, leading to an additional electrohydrodynamic pumping action to that provided by the associated vibrating diaphragm regions 224. The resulting additional pumping action will result in an increase in the rectification efficiency, $\epsilon$, of each micropump 200 since the pressure head generated by the electric field (due to induced charges) will increase the amount of working fluid moving in the direction of each outlet nozzle-diffuser channel element 216 and decrease the amount of working fluid moving in the direction of each inlet nozzle-diffuser channel element 214. The number and spacing of the electrodes 250, 252 in the inlet and outlet nozzle-diffuser channel elements 214, 216 can be chosen as desired to achieve a desired enhanced pumping action of the working fluid by the micropumps 200.

The electrodes 250, 252 are connected by leads 251, 253 to two-phase or three-phase alternating voltage sources S1, S2 to establish the traveling electric fields in the working fluid in the inlet and outlet channel elements 214, 216. Both sets of electrodes 250, 252 are excited using a two-phase or three-phase power supply. The voltage amplitude and frequency may be about 100 V and about 20 to 30 kHz provided to electrodes 250, 252 for purposes of illustration and not limitation. The electrodes 250, 252 will be energized at all times of operation of the micropumps; e.g. both during contraction mode and expansion mode of the volume of the pumping chambers 212. Optionally, the electrodes 250, 252 may be de-energized when the pumping diaphragm regions 224 are located at one of the ends of the contraction mode or expansion mode.

From the above discussion, it is apparent that the present invention provides a micropump and microchannel cooling system, as well as cooling method, with increased flow rectification efficiency, $\epsilon$, useful for, although not limited to, removing heat generated by a heat-generating electronic component of an electronic device. The micropump 200 is advantageous in that it decreases space and electrical power requirements needed for operation, as compared to other types of micropumps, and eliminates the need for an external pump for a microchannel heat sink, in that it provides increased volume flow rate of the working fluid as a result of the enhanced pumping action achieved by energization of electrodes 250, 252, and in that it can be integrated in the microchannels 104 to provide an improved cooling system for heat-generating electronic components.

Moreover, microchemical analysis techniques and microdosing drug techniques are being developed and will require a micropump to deliver the appropriate fluid for analysis or other use. The invention provides a micropump to this end that can be integrated in such microanalyzer and microdosing devices.

Although the invention has been described with respect to certain embodiments thereof, those skilled in the art will appreciate that modifications, additions, and the like can be made thereto within the scope of the invention as set forth in the following claims.

We claim:

1. A micropump including one or more microchannels for receiving a fluid and a plurality of electrodes arranged and energized in a manner to impart electrohydrodynamic-induced flow to the fluid in the one or more microchannels, a vibratable diaphragm facing said one or more microchannels, and an actuator for imparting vibration motion to the diaphragm relative to fluid in the one or more microchannels, whereby the diaphragm vibration motion together with the electrohydrodynamic-induced flow produce a higher volume flow rate of fluid than the electrohydrodynamic-induced flow alone.

2. The micropump of claim 1 wherein the electrodes are disposed transverse to a direction of flow of the fluid in said one or more microchannels.

3. The micropump of claim 1 wherein the electrodes are disposed on a surface of the diaphragm facing said one or more microchannels.

4. The micropump of claim 1 wherein said one or more microchannels each have a constant width dimension perpendicular to a direction of flow of the fluid therethrough.

5. The micropump of claim 1 wherein said one or more microchannels each have a cross-sectional shape selected from trapezoidal, rectangular or triangular.

6. A method of delivering a fluid comprising a drug or medicine, including pumping the fluid using a micropump of claim 1 for delivery to a patient.

7. A micropump including one or more microchannels for receiving a fluid, a vibratable diaphragm closing off said one or more microchannels, and a plurality of electrodes disposed on a surface of the diaphragm facing said one or more microchannels and energized in a manner to impart electrohydrodynamic-induced flow to the fluid in the one or more microchannels, and an actuator for imparting vibration motion to the diaphragm, whereby the diaphragm vibration motion together with the electrohydrodynamic-induced flow produce a higher volume flow rate of fluid than the electrohydrodynamic-induced flow alone.

8. The micropump of claim 7 wherein the electrodes are disposed transverse to a direction of flow of the fluid in said one or more microchannels.

9. The micropump of claim 7 wherein said one or more microchannels each have a uniform width dimension perpendicular to a direction of flow of the fluid therethrough.

10. The micropump of claim 9 wherein said one or more microchannels each have a crosss-sectional shape selected from trapezoidal, rectangular or triangular.

11. Combination of a heat-generating electronic component and a micropump of claim 7 in thermal transfer relation with the component to remove heat therefrom, wherein the plurality of electrodes are arranged and energized in a manner to impart electrohydrodynamic-induced flow to the fluid in the one or more microchannels together with the diaphragm vibration motion relative to the fluid in the one or more microchannels such that a higher volume flow rate of fluid is achieved than with electrohydrodynamic-induced flow alone.

12. A method of cooling a heat-generating electronic component, comprising removing heat from the component using a micropump of claim 7 by disposing the one or more microchannels in thermal transfer relation to the component and energizing the plurality of electrodes in a manner to impart the electrohydrodynamic-induced flow to the fluid while vibrating the diaphragm relative to the fluid in the one or more microchannels such that a higher volume flow rate of fluid is achieved than with electrohydrodynamic-induced flow alone.

13. A method of flowing a fluid, comprising imparting motion to the fluid by energizing electrodes proximate the fluid in one or more microchannels to impart electrohydrodynamic-induced flow to the fluid while vibrating a diaphragm relative to the fluid in the one or more microchannels such that a higher volume flow rate of fluid is achieved than with electrohydrodynamic-induced flow alone.

14. The method of claim 13 wherein vibration is imparted to the fluid.

* * * * *